343-700 MS AU 251 EX
12/30/86 OR 4,633,262

United States Patent [19]

Traut

[11] Patent Number: 4,633,262

[45] Date of Patent: Dec. 30, 1986

[54] MICROSTRIP ANTENNA WITH PROTECTIVE CASING

[75] Inventor: G. Robert Traut, Danielson, Conn.

[73] Assignee: Rogers Corporation, Rogers, Conn.

[21] Appl. No.: 424,833

[22] Filed: Sep. 27, 1982

[51] Int. Cl.[4] ..... H01Q 1/38

[52] U.S. Cl. ..... 343/700 MS; 343/785

[58] Field of Search ..... 343/700 MS, 785

[56] References Cited

U.S. PATENT DOCUMENTS

| | | | |
|---|---|---|---|
| 4,160,976 | 0/1979 | Conroy | 343/700 MS |
| 4,180,818 | 0/1979 | Schwartz | 343/700 MS |
| 4,218,682 | 0/1980 | Yu | 343/700 MS |
| 4,347,516 | 8/1982 | Shrekenhamer | 343/700 MS |
| 4,366,484 | 12/1982 | Weiss et al. | 343/700 MS |
| 4,415,900 | 11/1983 | Kaloi | 343/700 MS |

OTHER PUBLICATIONS

Feasibility of Designing Millimeter Microstrip Planar Antenna Arrays by P. S. Hall et al. 4–8 Sep. 1978.

Conference Agard Conference Proceedings No. 245 Millimeter and Submillimeter Wave Application and CKTS Munich, Germany Photoetched Antennas by Donald J. Sommers Jul. 1955 Electronics pp. 130–133.

*Primary Examiner*—Eli Lieberman
*Assistant Examiner*—K. Ohralik
*Attorney, Agent, or Firm*—Fishman & Dionne

[57] ABSTRACT

A microstrip antenna is presented in which the circuit pattern is on the inner side of a glass plate and is spaced from the ground plane by an air dielectric. The outer side of the glass plate serves as a protective cover for the circuit pattern and the ground plane.

7 Claims, 2 Drawing Figures

MICROSTRIP ANTENNA WITH PROTECTIVE CASING

BACKGROUND OF THE INVENTION

This invention relates to the field of microstrip or stripline antennas. More particularly, this invention relates to a planar microstrip antenna for use primarily as a receiver antenna for receiving broadcasted microwave signals. While this invention may have general utility in microwave transmission or reception, the invention will be described in the environment of what is known as a TV receive only (TVRO) receiver in a direct satellite broadcasting (DSB) system. However, it will be understood that the invention may have general utility as either a receiver antenna or transmittor antenna in microwave communication systems.

With the growing potential for satellite transmission of microwave signals for TV broadcasting and receiving systems, there is an increasing need for a reliable, durable and reasonably inexpensive antenna for household and other commercial use for the reception of satellite transmitted microwave signals. Parabolic antennas are traditionally used in transmission systems of this type, but they present many problems for an effective and commercially viable TV microwave reception system. Among other problems, parabolic antennas are relatively expensive, and are not sufficiently stable in low winds to guarantee consistent signal reception and hence picture quality. Thus, they are not particularly suitable for everyday use in home or other commercial TV reception systems.

Stripline or microstrip antennas for microwave transmission or reception are known in the art. Such antennas are shown, for example, in UK Pat. No. 1,529,361 to James and Wilson, U.S. Pat. No. 3,995,277 to M. Olyphant, Jr., U.S. Pat. No. 3,987,455 to M. Olyphant, Jr. and U.S. Pat. No. 3,803,623 to L. Scharlot, Jr. In all of these prior patents the antenna structure consists of a laminate structure of a dielectric material with an electrically conductive ground plane on one surface of the dielectric and a stripline or microstrip pattern on the other surface of the dielectric. It is well known that the properties of the dielectric material are important to the performance of the antenna, especially the properties of dielectric constant and dissipation factor. Those considerations make these conventional microstrip antennas practicably unsuitable for TVRO antennas because they severely limit the choice of suitable dielectric materials to very expensive materials, especially when one considers that a TVRO antenna must be relatively large, such as on the order of a square structure 30 to 40 inches on each side or a circular structure having a diameter of 30 to 40 inches. Also, since TVRO antennas will be used outdoors, they must be weatherized to protect them from exposure to the elements. This is particularly so with the conventional prior art stripline or microstrip antenns where the circuit pattern and the ground plane are on the exterior of the dielectric surfaces. This weatherizing requirement further adds to the economic and practical problems of using prior art microstrip antennas in TVRO systems.

The combined requirements of electrical properties and weathering resistance limit the choice of dielectric materials that may be effectively employed in a practicable TVRO antenna if one were constructed in accordance with conventional prior art techniques. The combined requirements of electrical properties and weathering resistance limit the choice of dielectric materials. Low loss ceramics would offer good performance for the dielectric material, but the cost and limited size of ceramic substrates would rule them out. PTFE (polytetrafluoroethylene) based substrates or substrates based on other fluoropolymers would also be acceptable choices from the standpoint of dielectric properties, but the cost of such substrates would make them unsuitable for home and general commercial use. Thus, because of the economic and other practical drawbacks, the art has not developed a commercially practicable and acceptable planar TVRO antenna.

SUMMARY OF THE INVENTION

The above-discussed and other problems of the prior art are overcome or reduced by the TVRO antenna of the present invention. In accordance with the preferred embodiment of the present invention, a planar TVRO antenna is constructed with glass supporting substrates for the ground plane and microstrip circuits and with air as the dielectric between the circuit pattern and the ground plane.

In accordance with the present invention, a ground plane is defined by a metallized surface on a first glass plate. The microstrip circuit pattern consists of a conductive pattern formed on a surface of a second glass plate. The first and second glass plates are assembled with the ground plane and the circuit pattern facing and spaced from each other to define an air space between the circuit pattern and the ground plane. The air space serves as and defines the dielectric between the circuit pattern and the ground plane. The microstrip antenna thus consists of the ground plane and the circuit pattern, each supported on and spaced from the other by a glass sheet with appropriate electrical connections thereto, and the air therebetween. The glass plate on which the circuit pattern is formed protects the circuit pattern from exposure to weather, thus significantly increasing the life expectancy of this TVRO antenna.

BRIEF DESCRIPTION OF THE DRAWING

Referring to the drawings, wherein like elements are numbered alike in the two figures.

DESCRIPTION OF THE PREFERRED EMBODIMENT

The preferred embodiment of the present invention uses glass as a base or substrate material for the ground plane and microstrip circuit pattern of a planar microstrip antenna. As the term "glass" is used in this invention, it will be understood to mean and include any amorphous inorganic transparent or translucent substance formed by fusion of sand, silica or other materials to produce a mass that cools to a rigid condition without crystallization, or any of the various inorganic or organic substances resembling glass in transparency, hardness and amorphous nature, as long as the material has the appropriate dielectric characteristics to make it suitable for use as a TVRO antenna.

Figure 1:
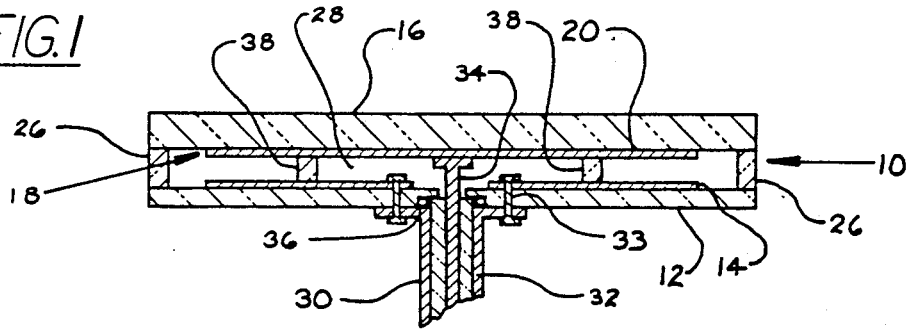
FIG. 1 is a sectional elevational view of an antenna constructed in accordance with the present invention.
Figure 2:
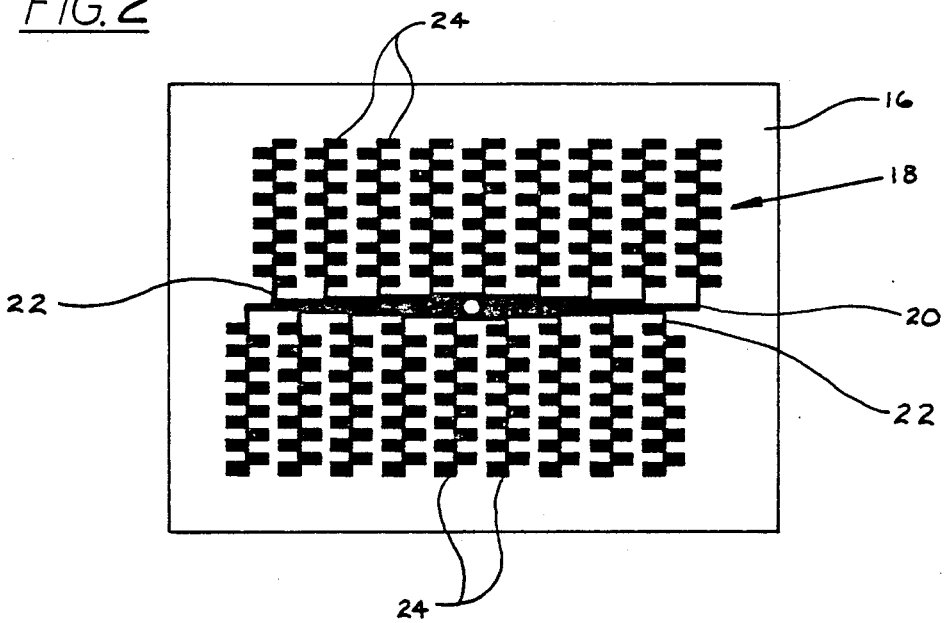
FIG. 2 is taken along line 2—2 of FIG. 1.

The planar antenna 10 has a lower glass plate or base 12 which carries a single monolithic ground plane 14. The antenna also has an upper glass plate 16 which carries an electrically conductive pattern of material 18 which constitutes the circuit pattern of the microwave antenna. As best seen in FIG. 2, the pattern 18 consists of a main feeder strip 20, a plurality of branch feeder strips 22 and a pattern of elements 24 extending from each branch feeder strip 22. It will be understood that the pattern of FIG. 2 is only by way of example. A variety of alternate patterns could be used that are capable of delivering the microwave energy in proper phase relationship to each radiating element.

Both ground plane 14 and circuit pattern 18 are bonded or adhered to their respective glass plates 12 and 16 by any suitable or convenient method. Ground plane 14 and circuit pattern 18 are metallized layers, such as, for example, copper or silver. The ground plane and the circuit pattern are bonded or adhered to their respective glass plates, and they may be formed on the glass plates by any suitable or convenient process, including mirror metallizing techniques, silk screening or other printed circuit techniques, or decal transfer techniques.

The antenna of the present invention also has glass edge pieces between the plates 12 and 16 and around the entire edge periphery of plates 12 and 16. These glass edge elements 26 serve both to maintain glass plates 12 and 16 spaced apart from each other and also hermetically seal the interior space 28 defined between glass plates 12 and 16. The edge strips 26 are bonded to the plates 12 and 16 by glass solder or other appropriate glass adhesives, and the coefficients of thermal expansion of glass plates 12 and 16 and edge strips 26 are matched to prevent the generation of thermal stress which might lead to cracking of the structure or separation of the bonded elements.

A coaxial cable 30 is connected to the antenna. One conductor 32 (the outer conductor) of the coaxial cable is connected to the ground plane 14, by conductive pins 33 which pass through glass plate 12 and the other conductor 34 (the inner or center conductor) of the coaxial cable is connected to main feeder 20 to deliver signals to the microwave pattern. A conductive adhesive may be used to bond and maintain contact between conductor 34 and feeder 20. An appropriate seal 36 is provided where the coaxial cable passes through plate 14 to maintain air space 28 as a hermetically sealed space. It will be understood that coaxial cable 30 and its connections to the ground plane and feeder are shown schematically and by way of illustration only. Any suitable connection arrangement may be used.

For the TVRO antenna application primarily envisioned for the present invention, the structure will be relatively large, such as on the order of a square or rectangle 30 to 40 inches on each side or a circle 30 to 40 inches in diameter. It is important for proper signal reception and the maintaining of consistent picture quality in the television set to which the antenna is connected that the spatial relationship between electronic components remain constant. Movement of the glass plates 12 and 16 in their respective circuit components relative to each other will have adverse effects. Such movement might be caused by forces (e.g. wind, loads) acting on plate 16 or by sagging of plate 16 relative to plate 12. To maintain the proper spacing between plates 12 and 16, glass spacer elements 38 may be located between the plates and may be bonded to the plates.

Microstrip pattern 18 is designed and selected so that it would generate a plane wave if it were a microwave transmitter. Since microwave transmitters and receivers are reciprocal, circuit pattern 18 will receive a plane wave from a specific direction, such as a geostationary or equatorial satellite. Glass plate 16 should, ideally, have a thickness of approximately ½ wavelength of the signal being received (12 to 14 GHz for the stationary OTS satellite now in operation). However, that ideal configuration would likely make the antenna too heavy. Therefore, glass plate 16 may be of the order of 1/10th inch thick to reduce weight. This dimensioning will result in some reflective losses but will still make the antenna an acceptable unit. As previously indicated, space 28 between glass plates 12 and 16 is preferrably an air space, with the air serving as a suitable dielectric. However, space 28 may also be filled with inert gas or be a vacuum.

From the foregoing description it will be recognized that a particularly effective, practical and economical planar TVRO antenna has been achieved by the present invention. The antenna is dimensionally stable, and, hence, it may be mounted on the exterior of buildings (such as roof houses or other similar structures), and it may be mounted in rotatable structure for directional alignment without impairing the reception of the transmitted signal, and hence the consistency of the picture displayed on the TV screen to which the antenna is connected.

A particularly important and useful feature for outdoor antennas is that the antenna is protected from the weather by the overall hermetically sealed structure of the antenna, and the upper plate 16 protects the circuit pattern from the weather. Thus, the antenna will last for many years of outdoor use.

While glass has been described as the preferred material for plates 12 and 16, other rigid materials may be used as long as plate 16 has a dielectric constant of 8 or less and a low dissipation (loss tangent of 0.01 or less).

While a preferred embodiment has been shown and described, various modifications and substitutions may be made thereto without departing from the spirit and scope of the invention. Accordingly, it is to be understood that the present invention has been described by way of illustrations and not limitation.

What is claimed is:

1. A microstrip antenna including:

a first glass plate;

first conductive means on one surface of said first plate defining a ground plane for a microstrip antenna;

a second glass plate spaced from said first glass plate, said space between said glass plates being hermetically sealed;

second conductive means on one surface of said second plate defining a microstrip antenna circuit pattern, said pattern comprising a plurality of transmission lines and radiating elements;

said first and second conductive means being on interior facing surfaces of the first and second plates; and spacer means for maintaining said first and second plates in spaced apart relation and defining a space between said plates.

2. A microstrip antenna as in claim 1 wherein:

said second plate has a dielectric constant of not more than 8 and a loss tangent of not more than 0.01.

3. A microstrip antenna as in claim 1 wherein:

said second plate has a thickness of between approximately 0.1 inches to one half the wavelength of a microwave signal being received by the antenna.

4. A microstrip antenna as in claim 1 wherein:

the coefficients of thermal expansion of said first and second plate and said spacer means are matched.

5. A microwave antenna as in claim 1 wherein: said space between said plates contains air.

6. A microwave antenna as in claim 1 wherein: said space between said plates contains an inert gas.

7. A microwave antenna as in claim 1 wherein: said space between said plates is evacuated.

* * * * *